US005951014A

United States Patent [19]

Nadel

[11] Patent Number: 5,951,014

[45] Date of Patent: Sep. 14, 1999

[54] SELF-ILLUMINATING BALL PADDLE

[76] Inventor: Craig P. Nadel, 20 Tomalyn Hill Rd, Montville, N.J. 07045

[21] Appl. No.: 09/105,685

[22] Filed: Jun. 26, 1998

Related U.S. Application Data

[60] Provisional application No. 60/050,841, Jun. 26, 1997.

[51] Int. Cl.[6] ..... A63B 67/20

[52] U.S. Cl. ..... 273/330

[58] Field of Search ..... 273/330; 473/527

[56] References Cited

U.S. PATENT DOCUMENTS

| | | | |
|---|---|---|---|
| 5,249,810 | 10/1993 | Cazalet | 273/330 |
| 5,377,996 | 1/1995 | Shure | 273/330 |
| 5,405,149 | 4/1995 | Allen | 273/330 |

*Primary Examiner*—William H. Grieb

*Attorney, Agent, or Firm*—Cohen, Pontani, Lieberman & Pavane

[57] ABSTRACT

A ball and paddle toy for generating an illumination effect when activated. The toy includes a paddle having a head portion and a handle portion configured for grasping by a user. A switch operable when a force exceeding a threshold force is applied thereto is connected to the paddle head portion. An elastic cord is connected at one end to the switch and at another end to a ball. An illuminating element is connected to the switch and is activated when the elastic cord applies a force exceeding the threshold force to the switch. When in use, the paddle is used to hit the ball, which causes the cord stretch and apply a force to the switch for activating the illuminating element.

7 Claims, 1 Drawing Sheet

SELF-ILLUMINATING BALL PADDLE

RELATED APPLICATIONS

This application claims priority from U.S. Provisional Patent Application Ser. No. 60/050,841 which was filed on Jun. 26, 1997.

FIELD OF THE INVENTION

The present invention is in a novelty device and more specifically in a self-illuminating ball paddle.

Novelty or entertainment devices are based on capturing a person's attention and especially a person's visual focus. It is more likely that a novelty device with a number of varied features, or one or more features that vary, will be deemed more interesting to a user. Color is an often employed feature to attract one's attention, and especially to attract the attention of children. However, even color will not retain attention or interest for any great length of time. Attention span or interest is often of limited duration.

Another feature which tends to attract attention is motion or, perhaps more accurately, the lack of a static condition. For instance, blinking lights are widely used for advertising purposes and to attract one's eye at, by way of example, at an intersection. Blinking lights tend to extend the attention span for a short period.

Games of skill generally require, at least initially, a high level of attentiveness. However, the more simple the skill, the lower the level of attentiveness.

The present invention is a device, the use of which requires hand-eye coordination but which can also extend the attention span. In particular, the invention is in a game paddle with features of a novelty device to enhance the enjoyment of play.

SUMMARY OF THE INVENTION

The present invention provides a self-illuminating interactive novelty device and, in particular, a self-illuminating ball paddle. The ball paddle of the invention generates an illuminated appearance which is periodic while the paddle is in use.

The self-illuminating ball paddle of the invention is formed of a paddle which is at least partially constructed of one or more translucent materials. The paddle has a paddle head and a handle, the paddle head being constructed of at least two opposing surfaces and being connected to the paddle handle. The paddle has a self-contained or integral power source and an illumination source to provide light or a similar radiant phenomenon that travels through the translucent material to a light diverting pattern which is angularly oriented, with respect to the paddle surface, and formed on at least one of the opposing surfaces.

The paddle also includes an activator which the paddling action in the normal intended use of the ball paddle causes to operate so as to supply power to the illumination source which thereby emits light that travels through the translucent material. At least some portion of the light impinges on the light diverting pattern and/or exits from a bevelled surface and is therefore diffracted, causing the pattern to be illuminated.

For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
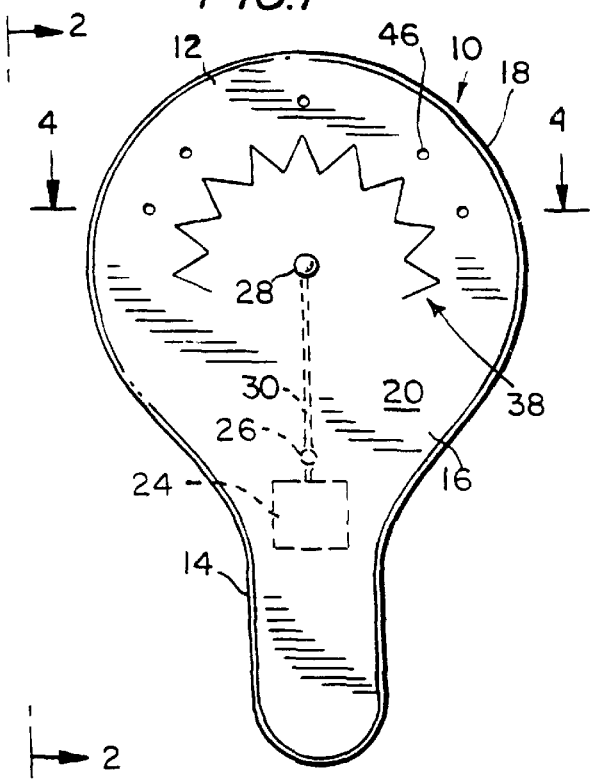
FIG. 1 is a plan view of the paddle of the invention.

Referring now to FIG. 1, a paddle 10 is formed of a substantially flat paddle head or face area 12 and a handle 14 shaped so as to be readily graspable by the hand of a user for manual use. The paddle, or at least the paddle head and at least a portion of the handle, are constructed of a translucent material such as plastic, and preferably of polycarbonate. Other suitable translucent plastic materials include polyvinyl chloride (PVC), K resin, ABS, high impact polystyrene (HIS), acrylic, EVA, acetyl, and combinations thereof. Of course, polycarbonate also can be used in combination with the other listed plastics.

It is preferred that the paddle head and handle be fabricated as one piece but may, alternatively, be formed as separate working components and securely connected at an interface 16.

Figure 2:
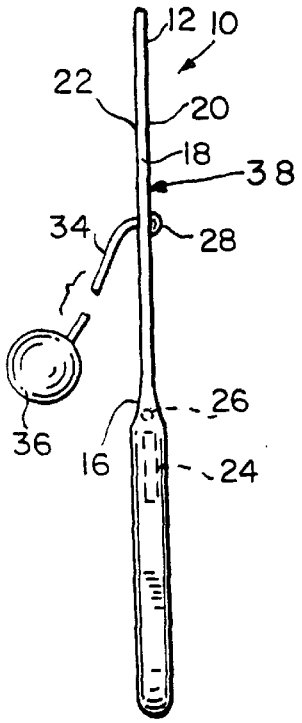
FIG. 2 is an edge view of the paddle of FIG. 1 taken along the lines 2—2.
Figure 3:
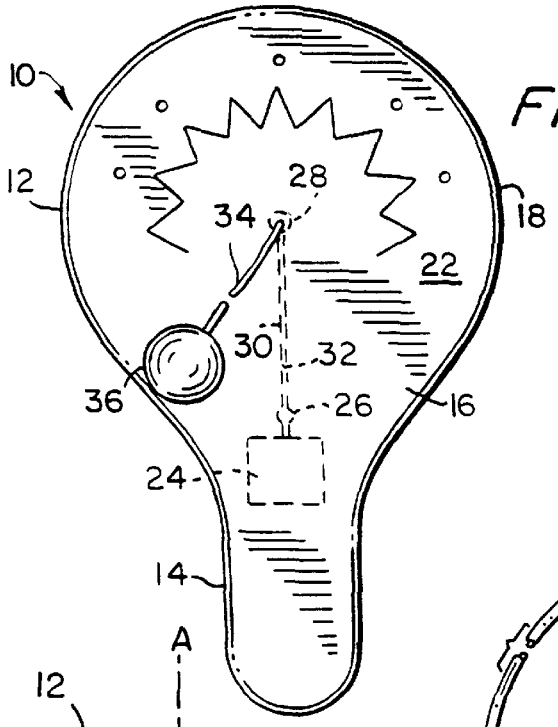
FIG. 3 is a plan view of the reverse side of the paddle of FIG. 1.

The paddle head and handle may be of the same thickness, which may be about ¼ to ⅜ of an inch thick or they may be of different thicknesses. Preferably, the handle is thicker than the paddle head. When of different thicknesses, the handle and head preferably smoothly converge at the interface 16 as shown in FIG. 2.

The paddle head is defined by an outer edge 18 and opposing face surfaces 20 and 22.

The paddle of the invention contains a power source 24 which is preferably a battery, and more preferably a miniature or disc battery that may be fully encased in the handle 14. Alternate power sources such as a film may be used in place of the battery as long as the illumination source is operable to provide the requisite power, as will be apparent from the following. The handle may be formed with a recessed area for enabling insertion of the power source during fabrication of the paddle 10; a cover or lid can then be firmly attached to cover and fully enclose the power source.

Also located within the paddle is an illumination source 26 that is disposed in operational contact with power source 24. The illumination source may be placed in direct contact with, or wired to, or otherwise connected in operational contact with power source 24. The illumination source 26 is preferably located at, or proximate to, the interface 16 or, if there is no interface, at a region of the paddle head closest to the handle or power source 24.

The illumination source may be a light bulb such as a pen-lite or like bulb as used in conventional consumer flashlights. Optionally, the source 26 may be a blinking light or may be attached to a flasher (not shown). Most preferably, illumination source 26 is a light emitting diode (LED). As should be apparent, the power source should be selected for compatibility with the illumination source so as to provide operating power at the proper voltage and current. The illumination source need not generate a white light but may, instead and as currently preferred, radiate at any color wavelength within the visible spectrum such as used in order to enhance the visual effectiveness of the inventive paddle as hereinafter explained.

Secured to the paddle 10 is a switch 28 which is preferably a DPST switch or equivalent thereof. Switch 28 may be mounted to the paddle head 12 and is substantially centrally located on the paddle head 12.

The switch 28 is connected to the power source 24. In a preferred embodiment the paddle head 12 has a cavity 30 that may be defined entirely internal to the head 12 so as to extend from the switch 28 to the power source 24. Electrical connecting leads 32 extend between the switch and power source through cavity 30. The power source, illumination source and leads may be preassembled and then inserted as a unit into the recess of the handle. The switch is also operatively connected to a flexible string or cord 34 which is affixed at its opposite end to a ball 36. The ball 36 is fabricated of a resilient material, such as rubber, and may be solid or hollow.

The head of the paddle has, on at least one of its surfaces 20, 22 a light diverting pattern 38. The light diverting pattern 38 is defined by at least one bevelled surface having a groove 42 which is cut from the surface into the paddle head interior. Groove 42 is defined by two opposed bevelled surfaces 40, 44, each of which are disposed at an angular orientation $\alpha$ with respect to the surface 20, 22 in which they are defined. The angle a is specifically herein the included angle between the bevelled surface and a plane oriented transverse or vertical to the paddle face, for example, line A—A of FIG. 4. The angular orientation of each of the bevelled surfaces 40, 44 may be the same or different; this range is most generally defined as $0<\alpha<90°$, preferably from about 25° to about 75°, and most preferably from about 30° to about 60°. The groove 42 may thus be formed by way of example as a "v" groove with surfaces 40, 44 having the same angular orientation $\alpha$ in an amount of from about 40° to 50°.

The surfaces 40, 44 may be roughened to the same or different extents. In another embodiment, one or more of the surfaces may be coated with a material that alters the effective transmission of the light emitted by the source 26 therethrough and may include light reflective or color filtrating materials, or both, or a layer of plastic or other material with a different refractive index. Of course, for safety concerns, the materials used should be shatterproof under the normal conditions of intended use.

Figure 4:
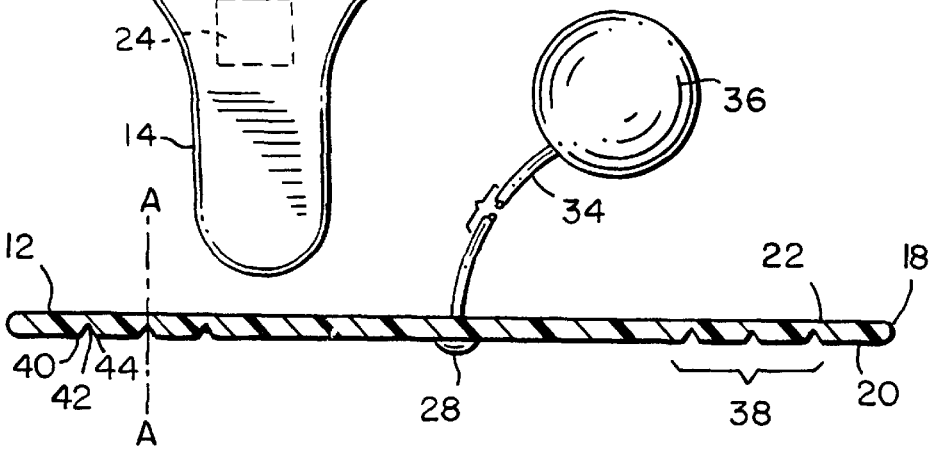
FIG. 4 is a view of the paddle of FIG. 1 taken along the lines 4—4.

Preferably, the light diverting pattern is formed of a plurality of such grooves 42, as illustrated in FIG. 4, so as to provide a similar appearance to the sunburst-like design which is shown by way of example in FIG. 1. The sunburst-like design may be symmetrically formed around the paddle head so that it at least partially surrounds switch 28 which is located proximate the center or focal point of the design. The grooves extend to a depth below the paddle surface for a distance, assuming a typical paddle head thickness of about ¼ to ⅜ inch, on the order of about ⅛ of an inch.

In another embodiment, the translucent material may have small particles of a different color or material dispersed therein to provide a further light diffracting or reflecting element.

Optionally, the paddle head may also include recessed dimples 46 positioned circumferentially to, or otherwise about, the head and/or surrounding, or surrounded by, the design 38.

When the user paddles the ball 36 in the usual manner in which conventional ball paddles are used, the tension in the cord 34, as the ball is driven or accelerated away from the paddle head 12 and reaches its maximum extension, causes the switch 28 to turn on, and then off, by which periodic power is delivered to the illumination source 26. The light from source 26 travels through the translucent material. At least some portion of this light impinges on the bevelled surface(s) 40, 42 or and/or dimples 46 causing the light to bend as it exits from the translucent material at the bevelled surfaces or dimples. Some of the bent light will reenter the translucent material as it impinges on, for example, surface 42. Where multiple grooves are employed, the exit, beveling and reentry sequence will repeat. Because of the bending of the light, there will be a significant degree of diffusion of the light, causing an attractive visual effect; the paddle will have the appearance of light emanating from each element of the design whenever the light 26 is illuminated.

It is also within the intended scope and contemplation of the invention that the light 26, rather than simply illuminating in one pulse or burst each time that the switch 28 is actuated, may alternatively flash or pulse a predetermined or random number of times to enhance the visual effect of the inventive paddle.

In another embodiment the back surface of the paddle face may be covered by a light reflecting layer or by a layer which is sensitive to the light to cause phosphorescence of the layer.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. A self-illuminating toy for generating light when activated, comprising:

a paddle having a head portion and a handle portion, said handle portion being configured for grasping by a user and said head portion being formed of a translucent material and having a contact surface, said contact surface having a light diverting pattern formed therein;

a switch mounted to said contact surface and being activated by a force exceeding a triggering force;

an elastic cord connected at one end to said switch;

a ball attached to another end of said cord for striking said contact surface when a tension force applied to said cord causes movement of said ball in a direction toward said head portion; and illuminating means connected to said switch for illuminating said contact surface when said cord applies a force exceeding said triggering force to said switch so that a portion of light from said illuminating means is directed to said light diverting pattern for generating a pleasing visual effect.

2. The toy of claim 1, wherein said light diverting pattern comprises a groove formed in said contact surface.

3. The toy of claim 1, wherein said handle portion and said head portion are integrally formed.

4. The toy of claim 1, wherein said translucent material contains light reflecting particles for enhancing the pleasing visual effect.

5. The toy of claim 1, further comprising a power source mounted to said paddle and connected to said switch and said illuminating means for providing operative power to said illuminating means when said switch is activated.

6. The toy of claim 5, wherein said illuminating means comprises an LED.

7. The toy of claim 6, wherein said illumination means is also activated by said ball striking said contact surface.

* * * * *